US011543840B2

(12) United States Patent
Lin

(10) Patent No.: US 11,543,840 B2
(45) Date of Patent: Jan. 3, 2023

(54) VOLTAGE REGULATOR

(71) Applicant: Winbond Electronics Corp., Taichung (TW)

(72) Inventor: Chih-Feng Lin, Taichung (TW)

(73) Assignee: Winbond Electronics Corp., Taichung (TW)

( * ) Notice: Subject to any disclaimer, the term of this patent is extended or adjusted under 35 U.S.C. 154(b) by 85 days.

(21) Appl. No.: 17/324,090

(22) Filed: May 18, 2021

(65) Prior Publication Data

US 2022/0026940 A1 Jan. 27, 2022

(30) Foreign Application Priority Data

Jul. 21, 2020 (TW) ..... 109124554

(51) Int. Cl.
*G05F 1/46* (2006.01)
*G05F 3/26* (2006.01)
*G05F 1/565* (2006.01)

(52) U.S. Cl.
CPC ..... *G05F 1/465* (2013.01); *G05F 1/565* (2013.01); *G05F 3/262* (2013.01)

(58) Field of Classification Search
CPC ..... G05F 1/465; G05F 3/262; G05F 1/565
USPC ..... 323/273
See application file for complete search history.

(56) References Cited

U.S. PATENT DOCUMENTS 5,587,650 A * 12/1996 Massie ..... G05F 1/575 323/282
5,623,198 A * 4/1997 Massie ..... G05F 1/575 323/282
7,853,229 B2 12/2010 Maulik et al.
10,054,967 B2 8/2018 Lee
10,848,147 B2 * 11/2020 Rizvi ..... H03K 19/017509
2005/0007190 A1 1/2005 Hamamoto et al.
(Continued)

FOREIGN PATENT DOCUMENTS

CN 103631294 3/2014
CN 107667322 2/2018
(Continued)

OTHER PUBLICATIONS

"Office Action of Taiwan Counterpart Application", dated Nov. 9, 2020, p. 1-p. 7.

*Primary Examiner* — Yemane Mehari
(74) *Attorney, Agent, or Firm* — JCIPRNET

(57) ABSTRACT

A voltage regulator includes a main driving stage circuit, a first pre-driving circuit, a plurality of auxiliary driving stage circuits, a second pre-driving circuit, and a comparison and decoding circuit. The main driving stage circuit provides a main driving current of an output voltage according to a first control signal. Each of the auxiliary driving stage circuits determines whether to provide an auxiliary driving current of the output voltage according to a second control signal. The second pre-driving circuit generates the second control signal according to an enable signal. The comparison and decoding circuit generates a simulated driving current and generates a load current according to a reference current and a counting code, compares the simulated driving current with the load current to generate a comparison result, and generates the enable signal by decoding the comparison result. The counting code is generated according to the comparison result.

13 Claims, 4 Drawing Sheets

(56) References Cited

U.S. PATENT DOCUMENTS

| | | | |
|---|---|---|---|
| 2015/0234402 | A1 | 8/2015 | Kay et al. |
| 2016/0269029 | A1 | 9/2016 | Chou et al. |

FOREIGN PATENT DOCUMENTS

| | | |
|---|---|---|
| JP | 2002042467 | 2/2002 |
| TW | 201120608 | 6/2011 |
| TW | 201643583 | 12/2016 |
| TW | I620189 | 4/2018 |

* cited by examiner

VOLTAGE REGULATOR

CROSS-REFERENCE TO RELATED APPLICATION

This application claims the priority benefit of Taiwan application serial no. 109124554, filed on Jul. 21, 2020. The entirety of the above-mentioned patent application is hereby incorporated by reference herein and made a part of this specification.

BACKGROUND

Technical Field

The disclosure relates to a voltage regulator, and more particularly relates to a voltage regulator with a self-adjustable driving capability.

Description of Related Art

In the technical field of low drop-out (LDO) voltage regulators, the driving stage circuit of a voltage regulator can receive a power supply voltage in a certain range and is required to provide an output voltage of a preset voltage. However, due to factors such as drift of the process parameters, change of the operating temperature, shift of the power supply voltage, etc., the driving current of the output voltage of the voltage regulator may be insufficient. Corresponding to this, in the field of conventional technology, the designer tends to provide the driving stage circuit of the voltage regulator with a driving capability greater than the expected value, which results in over design of the voltage regulator.

Because of over design, the conventional voltage regulator not only wastes a large circuit area but also causes unnecessary power consumption for the excessive driving capability, which affects the overall performance of the circuit.

SUMMARY

The disclosure provides a voltage regulator with a driving capability self-adjusting function.

The voltage regulator of the disclosure includes a main driving stage circuit, a first pre-driving circuit, a plurality of auxiliary driving stage circuits, a second pre-driving circuit, and a comparison and decoding circuit. The main driving stage circuit is coupled to an output end of the voltage regulator, and provides a main driving current of an output voltage according to a first control signal. The first pre-driving circuit is coupled to the main driving stage circuit and generates the first control signal. The auxiliary driving stage circuits are coupled to the output end and are respectively controlled by a plurality of second control signals. Each of the auxiliary driving stage circuits determines whether to provide an auxiliary driving current of the output voltage according to the corresponding second control signal. The second pre-driving circuit is coupled to the auxiliary driving stage circuit and generates the second control signal according to an enable signal. The comparison and decoding circuit generates a simulated driving current and generates a load current according to a reference current and a counting code, compares the simulated driving current with the load current to generate a comparison result, and generates the enable signal by decoding the comparison result. The counting code is generated according to the comparison result.

Based on the above, according to the disclosure, the simulated driving current of the voltage regulator is compared with the load current, and then the number of activated auxiliary driving stage circuits is determined according to the comparison result. By adjusting the number of the auxiliary driving currents provided, the driving capability of the output voltage of the voltage regulator can be adjusted dynamically.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

Figure 1:
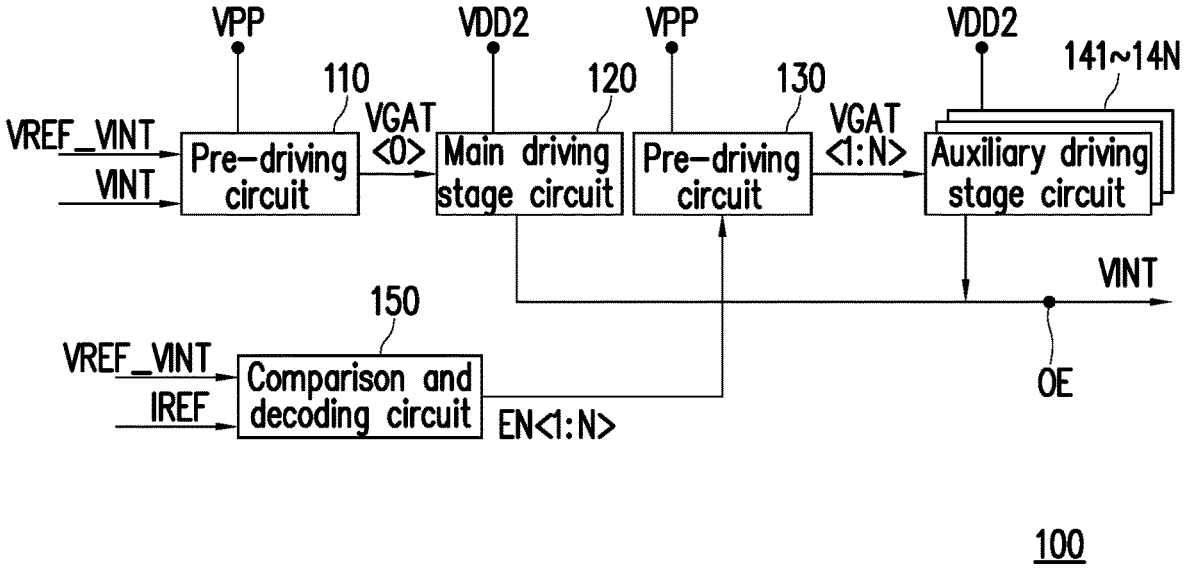
FIG. 1-2 are schematic diagrams of a voltage regulator according to the different embodiments of the disclosure.

Referring to FIG. 1, FIG. 1 is a schematic diagram of a voltage regulator according to an embodiment of the disclosure. The voltage regulator 100 includes a main driving stage circuit 120, pre-driving circuits 110 and 130, auxiliary driving stage circuits 141 to 14N, and a comparison and decoding circuit 150. The main driving stage circuit 120 is coupled to the output end OE of the voltage regulator 100. The main driving stage circuit 120 provides the main driving current of the output voltage VINT according to the control signal VGAT<0>. The pre-driving circuit 110 is coupled to the main driving stage circuit 120. The pre-driving circuit 110 receives the output voltage VINT and the reference voltage VREF_VINT, and generates the control signal VGAT<0> according to the output voltage VINT and the reference voltage VREF_VINT. In the present embodiment, the pre-driving circuit 110 detects the output voltage VINT by comparing the output voltage VINT with the reference voltage VREF_VINT, and generates the control signal VGAT<0> according to the difference between the output voltage VINT and the reference voltage VREF_VINT. Here, the reference voltage VREF_VINT is a preset voltage. In the present embodiment, the main driving stage circuit 120 may receive the power supply voltage VDD2 as the operating power supply, and the pre-driving circuit 110 may receive the power supply voltage VPP as the operating power supply. The power supply voltage VDD2 is different from the power supply voltage VPP, and for example, the power supply voltage VDD2>the power supply voltage VPP.

In addition, the auxiliary driving stage circuits 141 to 14N are coupled to the output end OE, and are respectively controlled by the control signals VGAT<1> to VGAT<N> (marked as VGAT<1:N> in the drawing). Whether each of the auxiliary driving stage circuits 141 to 14N is activated is determined according to the control signals VGAT<1> to VGAT<N> received, and each of the auxiliary driving stage circuits 141 to 14N provides an auxiliary driving current to the output voltage VINT. The number of the auxiliary driving stage circuits 141 to 14N that are activated may be proportional to the driving capability provided by the output voltage VINT.

The pre-driving circuit 130 is coupled to the auxiliary driving stage circuits 141 to 14N, and generates the control signal VGAT<1:N> according to the enable signal EN<1:N>. In the present embodiment, the auxiliary driving stage circuits 141 to 14N may receive the power supply voltage VDD2 as the operating power supply, and the pre-driving circuit 130 may receive the power supply voltage VPP as the operating power supply.

The enable signal EN<1:N> is provided by the comparison and decoding circuit 150. The comparison and decoding circuit 150 receives the reference voltage VREF_VINT and the reference current IREF, and generates the enable signal EN<1:N> according to the reference voltage VREF_VINT and the reference current IREF. More specifically, the comparison and decoding circuit 150 may generate a simulated driving current according to the power supply voltage VPP based on the power supply voltage VDD2. The comparison and decoding circuit 150 may generate a load current according to the reference current IREF and a counting code. The comparison and decoding circuit 150 generates a comparison result by comparing the simulated driving current with the load current, and then generates the enable signal EN<1:N> by decoding the comparison result.

It is worth mentioning that the counting code may be generated according to the comparison result. The comparison and decoding circuit 150 records the comparison result at a plurality of consecutive time points in time sequence to respectively obtain a plurality of bits of the counting code. The comparison and decoding circuit 150 may store the counting code at a first time point to obtain a temporary counting code, and compare the temporary counting code with a current counting code at a second time point after the first time point, so as to generate the enable signal EN<1:N>.

In an embodiment of the disclosure, the load current may be the reference current IREF multiplied by a mirror ratio, and the mirror ratio may be determined according to the counting code described above. Therefore, through the adjustment mechanism of the embodiment of the disclosure, the driving current provided by the output voltage VINT is substantially equal to the simulated driving current.

Figure 2:
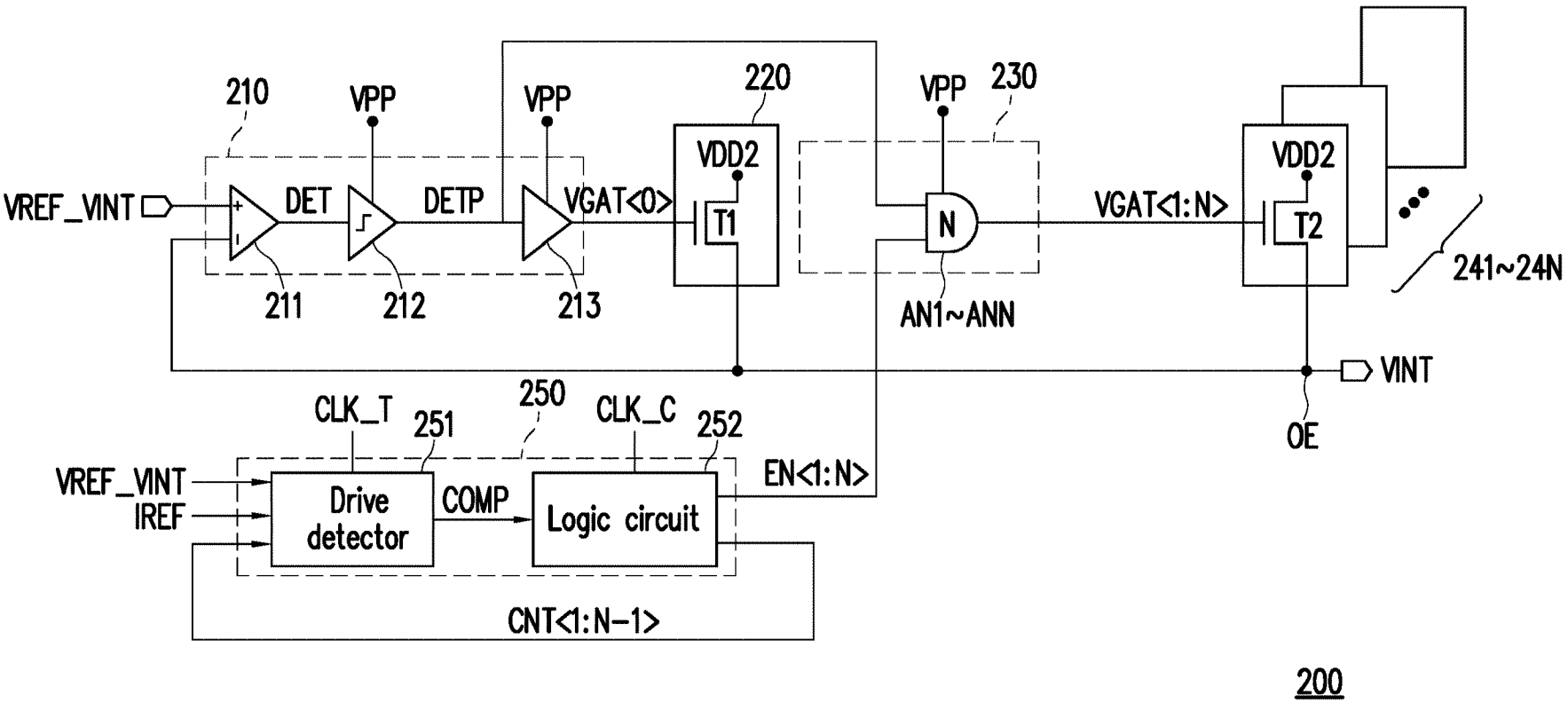

Referring to FIG. 2, FIG. 2 is a schematic diagram of a voltage regulator according to another embodiment of the disclosure. A voltage regulator 200 includes a main driving stage circuit 220, pre-driving circuits 210 and 230, auxiliary driving stage circuits 241 to 24N, and a comparison and decoding circuit 250. The main driving stage circuit 220 is composed of a transistor T1. The first end of the transistor T1 receives the power supply voltage VDD2 as the operating voltage, the second end of the transistor T1 is coupled to the output end OE, and the control end of the transistor T1 receives the control signal VGAT<0>. The pre-driving circuit 210 includes a voltage detector 211, a voltage shifter 212, and a pre-driver 213. The voltage detector 211 generates a detection signal DET by comparing the output voltage VINT with the reference voltage VREF_VINT. The voltage shifter 212 is coupled to the voltage detector 211 to receive the detection signal DET and shift the voltage level of the detection signal DET to generate a shifted detection signal DETP. The pre-driver 213 is coupled to the voltage shifter 212 and generates the control signal VGAT<0> according to the shifted detection signal DETP. In the present embodiment, the voltage shifter 212 and the pre-driver 213 receive the power supply voltage VPP as the operating voltage.

Regarding the circuit structures of the auxiliary driving stage circuits 241 to 24N, the auxiliary driving stage circuit 241 will be described as an example. The auxiliary driving stage circuit 241 is composed of a transistor T2. The first end of the transistor T2 receives the power supply voltage VDD2 as the operating voltage, the second end of the transistor T2 is coupled to the output end OE, and the control end of the transistor T2 receives the control signal VGAT<1>.

In addition, the pre-driving circuit 230 includes a plurality of logic gates AN1 to ANN. The logic gates AN1 to ANN jointly receive the shifted detection signal DETP, and respectively receive a plurality of bits of the enable signal EN<1:N>. In the present embodiment, the logic gates AN1 to ANN are all AND gates. The logic gates AN1 to ANN receive the power supply voltage VPP as the operating voltage. The logic gates AN1 to ANN respectively correspond to the auxiliary driving stage circuits 241 to 24N, and generate a plurality of corresponding control signals VGAT<1> to VGAT<N> (marked as VGAT<1:N> in the drawing).

The comparison and decoding circuit 250 includes a drive detector 251 and a logic circuit 252. The drive detector 251 receives the reference voltage VREF_VINT, the reference current IREF, and the counting code CNT<1:N−1>. The logic circuit 252 is coupled to the drive detector 251 and receives the comparison result COMP generated by the drive detector 251, generates the counting code CNT<1:N−1> according to the comparison result COMP, and then generates the enable signal EN<1:N> by decoding the counting code CNT<1:N−1>. In the present embodiment, the number of bits of the enable signal EN<1:N> is one more than the number of bits of the counting code CNT<1:N−1>.

In the present embodiment, the drive detector 251 and the logic circuit 252 may respectively receive different clock signals CLK_T and CLK_C, and perform operations respectively based on the clock signals CLK_T and CLK_C.

Figure 3:
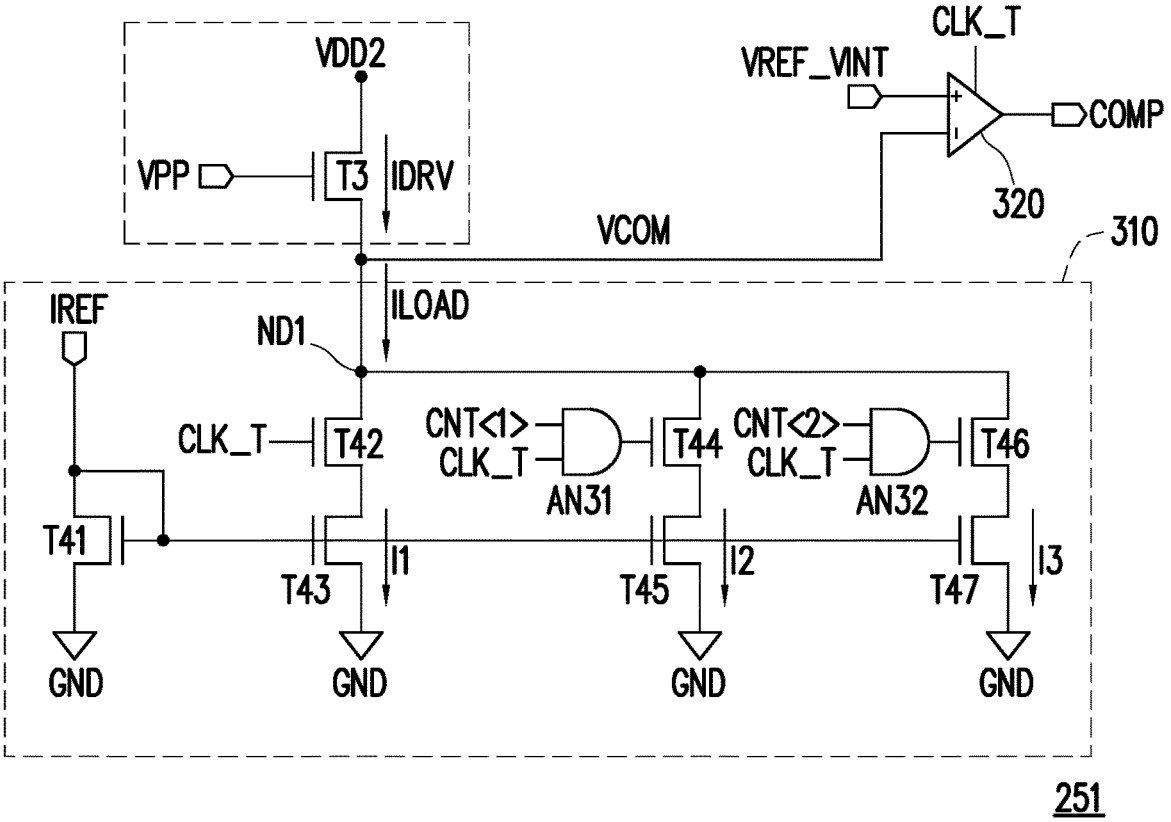
FIG. 3 is a schematic diagram of implementation of a drive detector in the embodiment of FIG. 2 of the disclosure.

Regarding details of implementation of the drive detector 251, please refer to FIG. 3 for a schematic diagram of implementation of the drive detector in the embodiment of FIG. 2 of the disclosure. In FIG. 3, the drive detector 251 includes a transistor T3, a current mirror circuit 310, and a comparator 320. The transistor T3 receives the power supply voltage VDD2 as the operating voltage, and generates the simulated driving current IDRV according to the power supply voltage VPP. The transistor T3 drives the simulated driving current IDRV to flow to the node ND1. The transistor T3 may be used to copy the behavior of the main driving stage circuit (for example, the transistor T1 in FIG. 2). The transistor T3 and the transistor T1 may be configured as transistors having the same electrical characteristics.

The current mirror circuit 310 includes transistors T41 to T47. One end of the transistor T41 receives the reference current IREF, and the transistors T43, T45, and T47 are used to mirror the reference current IREF to generate the load current ILOAD. In addition, the transistors T42, T44, and T46 are respectively coupled to the transistors T43, T45, and T47, and are jointly coupled to the node ND1. The control end of the transistor T42 receives the clock signal CLK_T; the control end of the transistor T44 is coupled to the AND gate AN31; and the control end of the transistor T46 is coupled to the AND gate AN32. In addition, the AND gate AN31 receives the first bit CNT<1> of the counting code CNT<1:2> and the clock signal CLK_T, and the AND gate AN32 receives the second bit CNT<2> of the counting code CNT<1:2> and the clock signal CLK_T. When the clock signal CLK_T is at the logic level 1, and the counting code CNT<1:2> is 0 0, only the transistor T42 is turned on, and the transistor T43 is enabled to mirror the reference current IREF to generate the load current ILOAD equal to the current I1. When the clock signal CLK_T is at the logic level 1, and the counting code CNT<1:2> is 1 0, the transistors T42 and T44 are turned on and the transistor T46 is turned off, and the transistors T43 and T45 are enabled to mirror the reference current IREF to generate the load current ILOAD equal to the current I1+I2. When the clock signal CLK_T is at the logic level 1, and the counting code CNT<1:2> is 1 1, the transistors T42, T44, and T46 are all turned on, and the transistors T43, T45, and T47 are enabled to mirror the reference current IREF to generate the load current ILOAD equal to the current I1+I2+I3.

In the present embodiment, the relationship between the currents I1, I2, and I3 may be adjusted by adjusting the channel length/width ratios of the transistors T43, T45, and T47. For example, if the channel length/width ratios of the transistors T43 and T45 are set to be the same, the current I1 may be equal to the current I2. If the channel length/width ratio of the transistor T47 is twice the channel length/width ratio of the transistor T45, the current I3 may be twice the current I2. Assuming that the current I1 is 1 microampere, when the counting code CNT<1:2> is 0 0, the load current ILOAD may be 1 microampere; when the counting code CNT<1:2> is 1 0, the load current ILOAD may be 2 microamperes; and when the counting code CNT<1:2> is 1 1, the load current ILOAD may be 4 microamperes.

Here, the current mirror circuit 310 may draw the current ILOAD from the node ND1 to the reference ground end GND. Thereby, the voltage VCOMP on the node ND1 may be determined according to whether the simulated driving current IDRV is greater than the load current ILOAD. Specifically, when the simulated driving current IDRV is greater than the load current ILOAD, the voltage VCOMP on the node ND1 is pulled up. In addition, when the simulated driving current IDRV is less than the load current ILOAD, the voltage VCOMP on the node ND1 is pulled down. If the simulated driving current IDRV is equal to the load current ILOAD, the voltage VCOMP on the node ND1 does not change.

The comparator 320 may be implemented using an operational amplifier. The negative input end of the comparator 320 receives the voltage VCOMP, and the positive input end of the comparator 320 receives the reference voltage VREF_VINT. The comparator 320 compares the voltage VCOMP with the reference voltage VREF_VINT, and thereby generates the comparison result COMP. In the present embodiment, when the voltage VCOMP is less than the reference voltage VREF_VINT, the comparison result COMP may be at the logic level 1; and in contrast, when the voltage VCOMP is greater than the reference voltage VREF_VINT, the comparison result COMP may be at the logic level 0.

Figure 4:
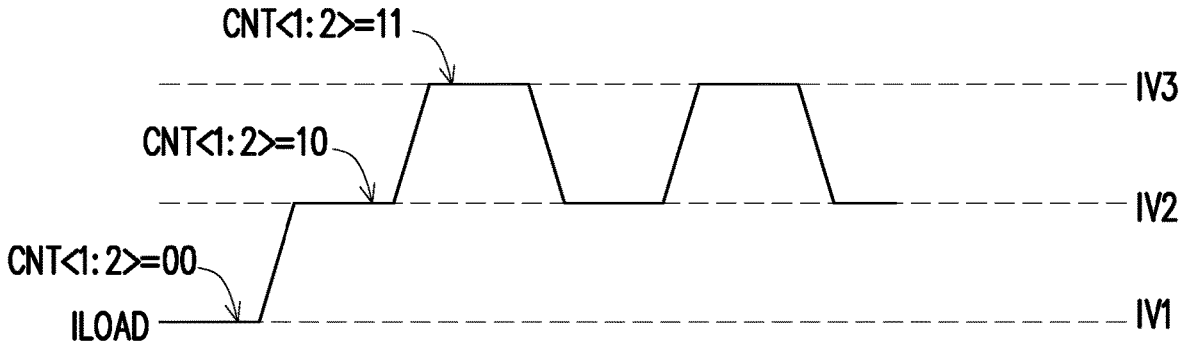
FIG. 4 is a waveform diagram showing the relationship between a load current and a counting code according to an embodiment of the disclosure.

Hereinafter, referring to FIG. 4, FIG. 4 is a waveform diagram showing the relationship between the load current and the counting code according to an embodiment of the disclosure. When the counting code CNT<1:2> is 0 0, the load current ILOAD may be equal to the current value IV1. After the counting code CNT<1:2> is changed to 1 0, the load current ILOAD may rise from the current value IV1 to the current value IV2. After the counting code CNT<1:2> is changed to 1 1, the load current ILOAD may rise from the current value IV2 to the current value IV3. If the load current ILOAD to be generated is between the current values IV2 and IV3, the counting code CNT<1:2> may be changed periodically between 1 1 and 1 0, so that the average current value of the load current ILOAD is between the current values IV2 and IV3. The average current value of the load current ILOAD may be adjusted up or down by adjusting the ratio between the first time length when the counting code CNT<1:2> is equal to 1 1, and the second time length when the counting code CNT<1:2> is equal to 1 0.

Furthermore, based on that the simulated driving current IDRV is used to generate and copy the driving current provided by the main driving stage circuit, in the embodiment of the disclosure, the load current ILOAD is set equal to (close to) the simulated driving current IDRV by adjusting the counting code CNT<1:2>. Therefore, when the load current ILOAD indicated by CNT<1:2> is larger, it means that the main driving stage circuit can provide a larger driving current, and it also means that there are fewer auxiliary driving stage circuits that need to be activated. In contrast, when the load current ILOAD indicated by CNT<1:2> is smaller, it means that the main driving stage circuit can provide a smaller driving current, and it also means that there are more auxiliary driving stage circuits that need to be activated.

Figure 5:
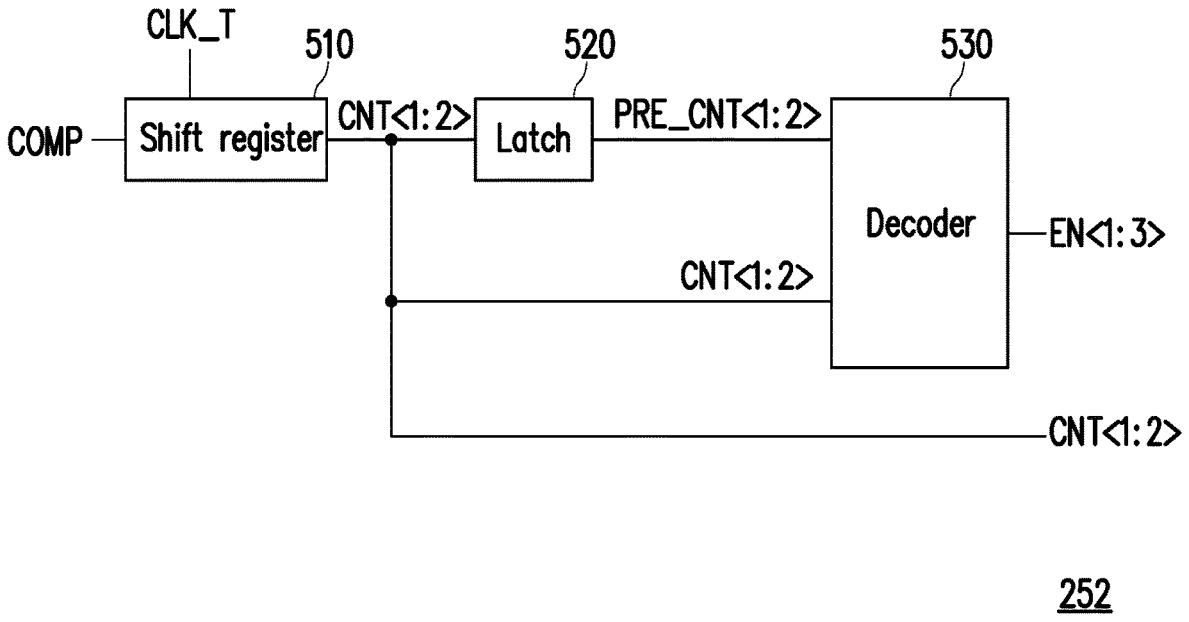
FIG. 5 is a schematic diagram of implementation of a logic circuit in the embodiment of FIG. 3 of the disclosure.

Hereinafter, referring to FIG. 5, FIG. 5 is a schematic diagram of implementation of the logic circuit in the embodiment of FIG. 3 of the disclosure. The logic circuit 252 includes a shift register 510, a latch 520, and a decoder 530. The shift register 510 receives the comparison result COMP, and performs a shift operation according to time sequence on the comparison result COMP according to the clock signal CLK_C. The counting code CNT<1:2> may be obtained by fetching two latest bits in the shift register 510. The latch 520 is coupled to the shift register 510 to receive the counting code CNT<1:2>. The latch 520 operates according to the clock signal CLK_C, and stores the counting code CNT<1:2> at the first time point to obtain the temporary counting code PRE_CNT<1:2>. The decoder 530 is coupled to the latch 520, and receives the temporary counting code PRE_CNT<1:2> at the second time point after the first time point and the current counting code CNT<1:2> provided by the shift register 510 at the second time point. The decoder 530 determines the change state of the counting code CNT<1:2> according to the temporary counting code PRE_CNT<1:2> and the current counting code CNT<1:2>, and generates a plurality of bits of the enable signal EN<1:3> according to the change state.

For example, the relationship between the change state of the counting code CNT<1:2> and the enable signal EN<1:3> is as listed in Table 1 below:

Table 1:

TABLE 1

| PRE_CNT<1:2>, CNT<1:2> | EN<1:3> | Activation rate |
|---|---|---|
| 11, 11 | 000 | 100% |
| 10/11, 11/01 | 100 | 200% |
| 00/10, 10/11 | 110 | 300% |
| 00, 00 | 111 | 400% |

In Table 1, when the temporary counting code PRE_CNT<1:2> and the current counting code CNT<1:2> are both 1 1, the decoder 530 correspondingly generates the enable signal EN<1:3> equal to 0 0 0; when the temporary counting code PRE_CNT<1:2> and the current counting code CNT<1:2> are 1 0 and 1 1 respectively or the temporary counting code PRE_CNT<1:2> and the current counting code CNT<1:2> are 1 1 and 0 1 respectively, the decoder 530 correspondingly generates the enable signal EN<1:3> equal to 1 0 0; when the temporary counting code PRE_CNT<1:2> and the current counting code CNT<1:2> are 0

0 and 1 0 respectively or the temporary counting code PRE_CNT<1:2> and the current counting code CNT<1:2> 1 0 and 1 1 respectively, the decoder 530 correspondingly generates the enable signal EN<1:3> equal to 1 1 0; and when the temporary counting code PRE_CNT<1:2> and the current counting code CNT<1:2> are both 0 0, the decoder 530 correspondingly generates the enable signal EN<1:3> equal to 1 1 1.

The above described Table 1 may be implemented in the form of a lookup table and set in the logic circuit 252. The lookup table may be realized using a memory, a register or any data storage component for recording the relationship between the change state of the temporary counting code PRE_CNT<1:2> and the current counting code CNT<1:2>, and the enable signal EN<1:3>.

In addition, in the embodiment of the disclosure, the number of activated auxiliary driving stage circuits of the voltage regulator is equal to the number of bits, which are at the logic level 1, in the enable signal EN<1:3>. On the premise that the main driving stage circuit is always activated, when the enable signal EN<1:3>=0 0 0, the activation rate of the driving stage circuits is 100%; when the enable signal EN<1:3>=1 0 0, the activation rate of the driving stage circuits is 200%; when the enable signal EN<1:3>=1 1 0, the activation rate of the driving stage circuits is 300%; and when the enable signal EN<1:3>=1 1 1, the activation rate of the driving stage circuits is 400%.

In summary, according to the disclosure, the enable signal is generated by generating the simulated driving current and comparing the simulated driving current with the load current. Further, according to the disclosure, the number of auxiliary driving stage circuits that are to be activated is determined through the enable signal, so that the voltage regulator has an effective driving capability corresponding to changes of different power supply voltages.

What is claimed is:

1. A voltage regulator, comprising:

a main driving stage circuit coupled to an output end of the voltage regulator and providing a main driving current of an output voltage according to a first control signal;

a first pre-driving circuit coupled to the main driving stage circuit and generating the first control signal;

a plurality of auxiliary driving stage circuits coupled to the output end and respectively controlled by a plurality of second control signals, wherein each of the auxiliary driving stage circuits determines whether to provide an auxiliary driving current of the output voltage according to the corresponding second control signal;

a second pre-driving circuit coupled to the auxiliary driving stage circuits and generating the second control signals according to an enable signal; and a comparison and decoding circuit generating a simulated driving current, generating a load current according to a reference current and a counting code, generating a comparison result by comparing the simulated driving current with the load current, and generating the enable signal by decoding the comparison result, wherein the counting code is generated according to the comparison result.

2. The voltage regulator according to claim 1, wherein the main driving stage circuit and the auxiliary driving stage circuits receive a first power supply voltage as an operating voltage, and the first pre-driving circuit and the second pre-driving circuit receive a second power supply voltage as an operating voltage, wherein the first power supply voltage is different from the second power supply voltage.

3. The voltage regulator according to claim 2, wherein the comparison and decoding circuit generates the simulated driving current according to the second power supply voltage based on the first power supply voltage.

4. The voltage regulator according to claim 1, wherein the comparison and decoding circuit records the comparison result at a plurality of consecutive time points in time sequence to respectively obtain a plurality of bits of the counting code.

5. The voltage regulator according to claim 1, wherein the comparison and decoding circuit stores the counting code at a first time point to obtain a temporary counting code, and compares the temporary counting code with a current counting code at a second time point to generate the enable signal.

6. The voltage regulator according to claim 1, wherein the main driving stage circuit is a first transistor, a first end of the first transistor receives a first power supply voltage, a second end of the first transistor is coupled to the output end, and a control end of the first transistor receives the first control signal.

7. The voltage regulator according to claim 6, wherein the first pre-driving circuit comprises:

a voltage detector generating a detection signal by comparing the output voltage with a reference voltage;

a voltage shifter coupled to the voltage detector and shifting a voltage level of the detection signal to generate a shifted detection signal; and a pre-driver coupled between the voltage shifter and the control end of the first transistor, and generating the first control signal according to the shifted detection signal, wherein the voltage shifter and the pre-driver receive a second power supply voltage as an operating voltage, and the first power supply voltage is different from the second power supply voltage.

8. The voltage regulator according to claim 7, wherein each of the auxiliary driving stage circuits is a second transistor, a first end of the second transistor receives the first power supply voltage, a second end of the second transistor is coupled to the output end, and a control end of the second transistor receives each of the second control signals.

9. The voltage regulator according to claim 8, wherein the second pre-driving circuit comprises:

a plurality of logic gates respectively receiving a plurality of bits of the enable signal and jointly receiving the shifted detection signal, wherein each of the logic gates generates the corresponding second control signal according to each of the bits of the enable signal and the shifted detection signal.

10. The voltage regulator according to claim 9, wherein the comparison and decoding circuit comprises:

a drive detector, comprising:

a third transistor receiving the first power supply voltage as an operating voltage, and generating the simulated driving current according to the second power supply voltage to flow to a first node;

a current mirror circuit receiving the reference current, determining a mirror ratio according to the counting code, and drawing the load current from the first node by mirroring the reference current according to the mirror ratio; and a comparator coupled to the first node and generating the comparison result by comparing the reference voltage with a voltage on the first node; and a logic circuit coupled to the comparator and generating the enable signal according to the comparison result.

11. The voltage regulator according to claim 10, wherein electrical characteristics of the third transistor are the same as electrical characteristics of the first transistor.

12. The voltage regulator according to claim 10, wherein the logic circuit comprises:

a shift register receiving the comparison result and shifting the comparison result according to time sequence to generate the counting code;

a latch coupled to the shift register and storing the counting code at a first time point to obtain a temporary counting code; and a decoder generating a plurality of bits of the enable signal according to a change state between the temporary counting code and the current counting code at a second time point after the first time point.

13. The voltage regulator according to claim 12, wherein the decoder comprises a lookup table that records a relationship between the change state and the bits of the enable signal.

* * * * *